US008275275B2

(12) United States Patent
Ishikawa et al.

(10) Patent No.: US 8,275,275 B2
(45) Date of Patent: Sep. 25, 2012

(54) IMAGE FORMING APPARATUS

(75) Inventors: Emiko Ishikawa, Tokyo (JP); Hiromi Ogiyama, Tokyo (JP); Yasunobu Shimizu, Zama (JP); Akio Kosuge, Yokohama (JP); Ken Yoshida, Chigasaki (JP); Jun Yura, Yokohama (JP); Naoyuki Ozaki, Zama (JP); Masako Yoshii, Yokohama (JP); Ichiro Maeda, Yokohama (JP); Shinji Aoki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 421 days.

(21) Appl. No.: 12/582,890

(22) Filed: Oct. 21, 2009

(65) Prior Publication Data

US 2010/0098446 A1 Apr. 22, 2010

(30) Foreign Application Priority Data

Oct. 22, 2008 (JP) ..... 2008-271667

(51) Int. Cl.
*G03G 15/00* (2006.01)

(52) U.S. Cl. ..... 399/48; 399/32; 399/51; 399/111; 399/262

(58) Field of Classification Search ..... 399/32, 399/58, 111, 262
See application file for complete search history.

(56) References Cited

U.S. PATENT DOCUMENTS

| | | | | |
|---|---|---|---|---|
| 4,536,082 | A * | 8/1985 | Motohashi et al. | 399/51 |
| 5,126,795 | A * | 6/1992 | Maruyama et al. | 399/231 |
| 5,194,945 | A * | 3/1993 | Kadowaki et al. | 358/520 |
| 5,659,836 | A * | 8/1997 | Hyakutake et al. | 399/16 |
| 5,708,915 | A * | 1/1998 | Noguchi et al. | 399/49 |
| 5,744,929 | A * | 4/1998 | Miyazaki | 318/696 |
| 5,887,217 | A * | 3/1999 | Mitekura et al. | 399/13 |
| 5,918,087 | A * | 6/1999 | Kimura et al. | 399/69 |
| RE36,935 | E * | 10/2000 | Haneda et al. | 399/302 |
| 6,249,304 | B1 | 6/2001 | Sawayama et al. | |
| 2003/0179419 | A1 * | 9/2003 | Abe | 358/474 |
| 2004/0126148 | A1 * | 7/2004 | Iwai et al. | 399/296 |
| 2007/0071477 | A1 * | 3/2007 | Tanaka | 399/82 |

FOREIGN PATENT DOCUMENTS

| | | | |
|---|---|---|---|
| JP | 04194874 | A * | 7/1992 |
| JP | 5-249787 | | 9/1993 |
| JP | 5-289472 | | 11/1993 |
| JP | 2001-194843 | | 7/2001 |
| JP | 2001-324840 | | 11/2001 |
| JP | 2002-357939 | | 12/2002 |
| JP | 2003-263036 | | 9/2003 |
| JP | 3558620 | | 5/2004 |
| JP | 2007-171461 | | 7/2007 |
| JP | 2007-272153 | | 10/2007 |
| JP | 2008-8991 | | 1/2008 |
| WO | WO98/15875 | | 4/1998 |

* cited by examiner

*Primary Examiner* — David Gray
*Assistant Examiner* — Francis Gray
(74) *Attorney, Agent, or Firm* — Cooper & Dunham LLP

(57) ABSTRACT

An image forming apparatus including a latent image carrier, a charger to evenly charge a surface of the latent image carrier, a writing device to irradiate a charged surface of the latent image carrier to form an electrostatic latent image, a writing device control unit to control the writing device, a developing device to develop the electrostatic latent image to form a toner image, a transfer device to transfer the toner image onto a transferred member, and a pre-transfer irradiating device to irradiate the charged surface of the latent image carrier during a period after development and before transfer. The writing device control unit controls the writing device based on a target image signal A and an image signal B output a single rotation of the latent image carrier after output of the target image signal A in a sub-scanning direction.

8 Claims, 9 Drawing Sheets

IMAGE FORMING APPARATUS

BACKGROUND

1. Technical Field

This disclosure relates to an image forming apparatus, and more particularly, to an image forming apparatus including a latent image carrier rotated to bear an electrostatic latent image on a surface thereof, a charger to evenly charge the surface of the latent image carrier, a writing device to irradiate a charged surface of the latent image carrier with a light beam according to image data to form an electrostatic latent image on the charged surface of the latent image carrier, a writing device control unit to control the writing device, a developing device to develop the electrostatic latent image with a developer to form a toner image on the charged surface of the latent image carrier, a transfer device to transfer the toner image formed on the charged surface of the latent image carrier onto a transferred member, and a pre-transfer irradiating device to irradiate the surface of the latent image carrier during a period between development and transfer.

2. Description of the Background

Related-art image forming apparatuses such as electrophotographic copiers and electrophotographic printers typically form a toner image on a recording medium (e.g., a sheet) according to image data using an electrophotographic method. In such a method, for example, a charger charges a surface of a latent image carrier (e.g., a photoconductor); a writing device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

Pre-transfer light irradiation is a well-known process performed during a period between development and transfer and using, for example, a pre-transfer lamp (PTL). Specifically, in pre-transfer light irradiation, light is directed onto the surface of the photoconductor having the toner image thereon during a period between development and transfer to reduce electric charge of the electrostatic latent image formed on the surface of the photoconductor below the toner image. Accordingly, a transfer current employed during transfer is able to flow efficiently to a transfer material, providing stable transfer efficiency from lower transfer currents to higher transfer currents. Further, in full-color image forming apparatuses in which toner images of multiple colors, such as yellow, magenta, cyan, and black, are sequentially transferred onto a sheet in a superimposed manner to form a full-color image on the sheet, performing pre-transfer light irradiation prevents toner of the toner images from being reversely transferred onto the surface of the photoconductor during transfer.

However, pre-transfer light irradiation may cause some problems. For example, in an image forming apparatus employing a reversal developing method, a photoconductor gains positive electric charge after transfer due to electric discharge during transfer regardless of whether or not pre-transfer light irradiation has been performed. In a case in which pre-transfer light irradiation has not been performed, an electric potential on a surface of the photoconductor does not exceed 0 V after transfer because an absolute value of the electric potential on the surface of the photoconductor before transfer is sufficiently large. As a result, a memory of an image formed on the photoconductor during a previous sequence of image forming operations can be erased before the surface of the photoconductor is charged again for the next sequence of image forming operations by performing irradiation after transfer as illustrated in FIG. 12A.

By contrast, in a case in which pre-transfer light irradiation has been performed, the electric potential on the surface of the photoconductor before transfer is around 0 V, so that the electric potential on the surface of the photoconductor becomes positive after transfer as illustrated in FIG. 12B. Further, during transfer, electric discharge tends to occur at a non-image portion of the toner image formed on the surface of the photoconductor compared with an image portion having toner thereon. As a result, the surface of the photoconductor tends to have a large positive electric charge at the non-image portion. Because speed of movement of electrons is considerably slow, an image memory having such a large positive electric potential cannot be erased even when irradiation is performed after transfer. Consequently, the memory of an image formed on the photoconductor during a previous sequence of image forming operations remains and causes an uneven image formed during the next sequence of image forming operations.

Published Unexamined Japanese Patent Application No. H05-289472 proposes provision of two chargers to erase such a positively-charged image memory. However, such an arrangement is costly and requires a large installation space.

SUMMARY

In one aspect of this disclosure, an image forming apparatus in which irradiation is performed before transfer of the toner image using a pre-transfer lamp is provided to reduce the occurrence of inferior images caused by memory effects at reduced cost without additionally including special processes and members.

In an illustrative embodiment, an image forming apparatus includes a latent image carrier rotated to bear an electrostatic latent image on a surface thereof, a charger to evenly charge the surface of the latent image carrier, a writing device to irradiate a charged surface of the latent image carrier with a light beam according to image data to form an electrostatic latent image on the charged surface of the latent image carrier, a writing device control unit to control the writing device, a developing device to develop the electrostatic latent image with a developer to form a toner image on the charged surface of the latent image carrier, a transfer device to transfer the toner image formed on the charged surface of the latent image carrier onto a transferred member, and a pre-transfer irradiating device to irradiate the charged surface of the latent image carrier during a period after development and before transfer. The writing device control unit controls the writing device based on a target image signal A and an image signal B output a single rotation of the latent image carrier after output of the target image signal A in a sub-scanning direction.

Additional aspects, features, and advantages of the present invention will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF EMBODIMENTS

Figure 1:
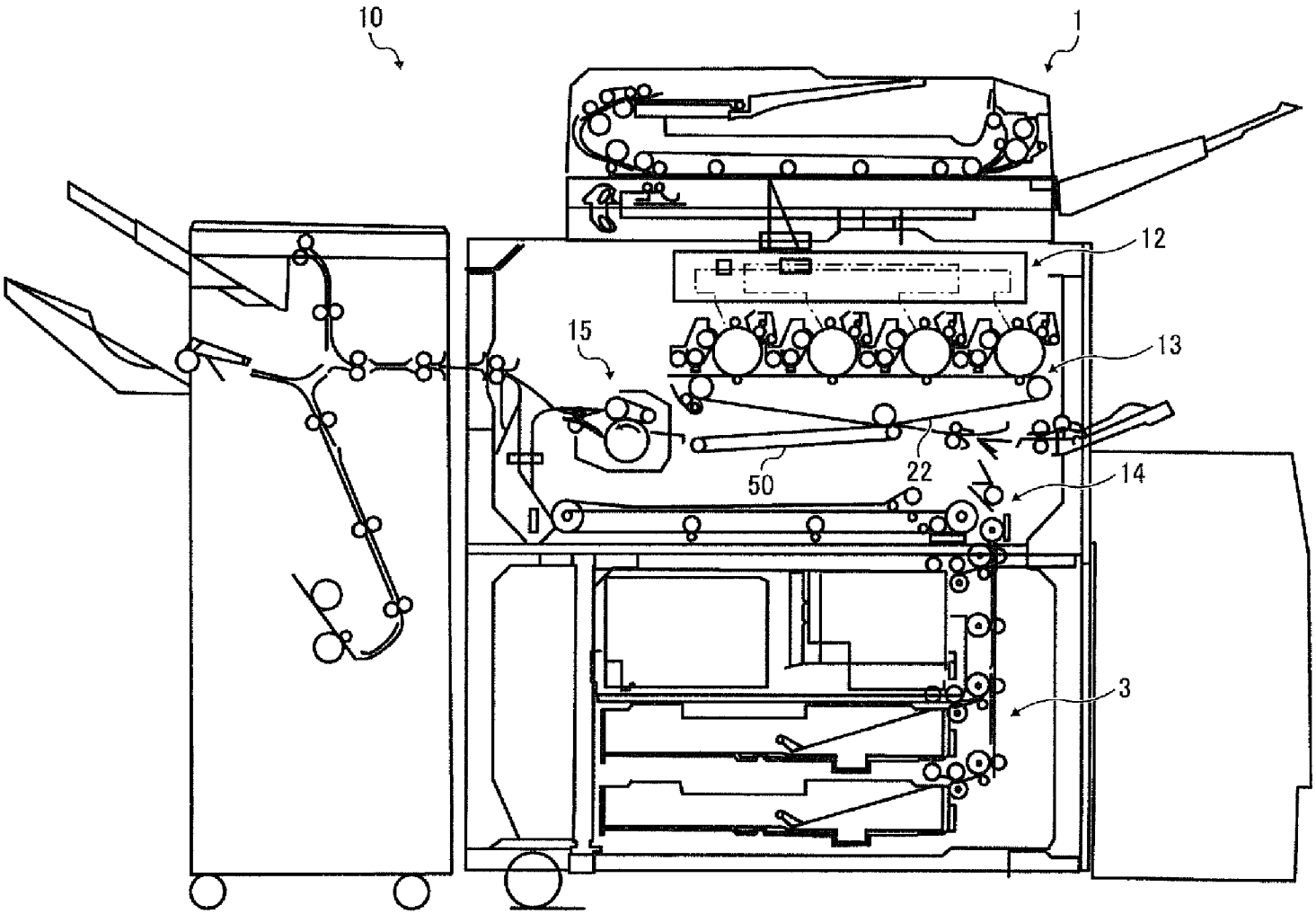
FIG. 1 is a cross-sectional view illustrating an overall configuration of an image forming apparatus according to illustrative embodiments.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Figure 2:
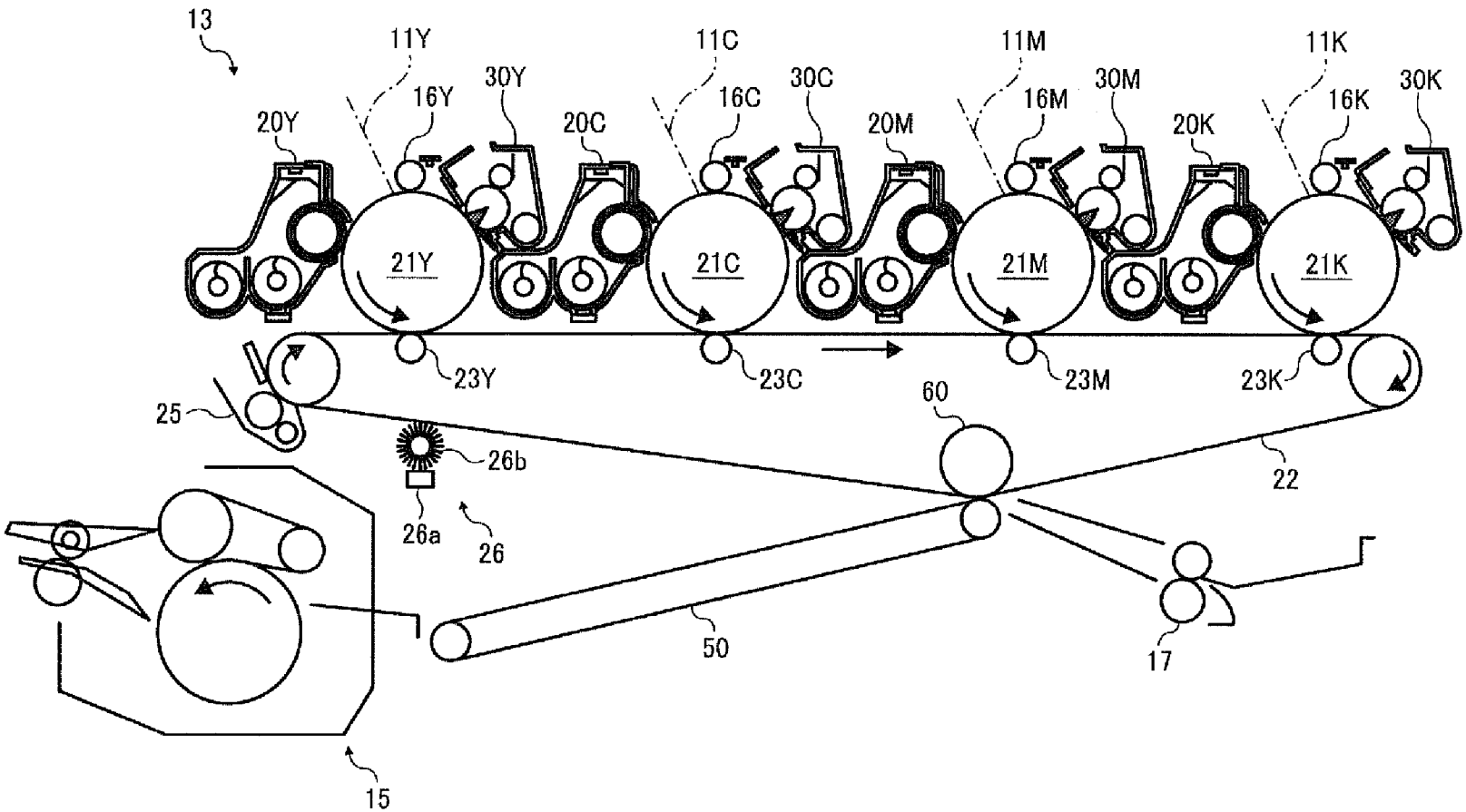
FIG. 2 is a schematic view illustrating a configuration of an image forming part of the image forming apparatus.

A description is now given of illustrative embodiments of an electrophotographic apparatus (hereinafter referred to as an image forming apparatus) 10. FIG. 1 is a cross-sectional view illustrating an overall configuration of the image forming apparatus 10. FIG. 2 is a schematic view illustrating a configuration of an image forming part of the image forming apparatus 10. The image forming apparatus 10 includes an image writing part 12, an image forming part 13, a paper feed part 14, and so forth to form full-color images using an electrophotographic method. The image forming apparatus 10 illustrated in FIG. 1 further includes an automatic document reading device 1 and a paper feeder 3.

A configuration and operations of the image forming apparatus 10 are described in detail below with reference to FIGS. 1 and 2.

First, an image signal output from the automatic document reading device 1 is separated into image signals of each color of yellow, magenta, cyan, or black. The image signals thus separated are sent to writing device control units, not shown, for the respective colors, and an amount of light for each color to be directed onto a surface of a photoconductor 21Y, 21M, 21C, or 21K is appropriately calculated by each of the writing device control units based on the image signals thus sent. The amounts of light for each color thus calculated are then sent to the image writing part 12 as signals.

Thus, for example, the image writing part 12 includes a laser light source, a deflector such as a rotary polygon mirror, a scanning optical imaging system, a laser scanning optical system including a group of mirrors, an LED writing system including an LED array in which multiple LEDs are arranged in one or two dimensions and an imaging optical system, and so forth. Four light beams 11Y, 11M, 11C, and 11K corresponding to the signals of the respective colors (hereinafter collectively referred to as light beams 11) are emitted from the image writing part 12 so that an image corresponding to each signal is written on each of the photoconductors 21Y, 21M, 21C, and 21K respectively provided to four image forming units, one of each color, included in the image forming part 13.

An ordinary OPC photoconductor is used for each of the photoconductors 21Y, 21M, 21C, and 21K for each color of yellow, magenta, cyan, or black (hereinafter correctively referred to as photoconductors 21) respectively provided in the image forming units of the image forming part 13. As illustrated in FIG. 2, provided around the photoconductors 21 are chargers 16Y, 16M, 16C, and 16K (hereinafter correctively referred to as chargers 16); portions to where the light beams 11 are directed from the image writing part 12, not shown; developing devices 20Y, 20M, 20C, and 20K for each color of yellow, magenta, cyan, or black (hereinafter collectively referred to as developing devices 20); primary transfer bias rollers 23Y, 23M, 23C, and 23K (hereinafter collectively referred to as primary transfer bias rollers 23) each serving as primary transfer means; cleaning devices 30Y, 30M, 30C, and 30K (hereinafter collectively referred to as cleaning devices 30), and so forth.

The developing devices 20 employ a two-component magnetic brush developing method. The image forming part 13 further includes an intermediate transfer belt 22 sandwiched between the photoconductors 21 and the primary transfer bias rollers 23. Toner images of each color respectively formed on the photoconductors 21 are sequentially transferred onto the intermediate transfer belt 22 in a superimposed manner.

A sheet of transfer paper fed from the paper feed part 14 or a paper feed bank of the image forming apparatus 10 is conveyed to a transfer conveyance belt 50 through a pair of registration rollers 17, and is borne by the transfer conveyance belt 50. The toner images sequentially transferred onto the intermediate transfer belt 22 in a superimposed manner are secondarily transferred onto the transfer paper by a secondary transfer bias roller 60 serving as secondary transfer means at a portion where the intermediate transfer belt 22 and the transfer conveyance belt 50 contact each other to transfer a full-color toner image onto the transfer paper. The transfer paper having the full-color toner image thereon is conveyed to a fixing device 15 by the transfer conveyance belt 50. The full-color toner image is fixed to the transfer paper by the fixing device 15, and the transfer paper having a fixed full-color image thereon is discharged from the image forming apparatus 10.

Toner not transferred onto the transfer paper at secondary transfer remains on the intermediate transfer belt 22 and is removed from the intermediate transfer belt 22 by a belt cleaning device 25. A lubricant agent coating device 26 is provided on an upstream side from the belt cleaning device 25 relative to a direction of rotation of the intermediate transfer belt 22. The lubricant agent coating device 26 includes a solid lubricant agent 26*a* and a conductive brush 26*b* contacting the intermediate transfer belt 22 to supply the solid lubricant agent 26*a* to the intermediate transfer belt 22. Specifically, the conductive brush 26*b* constantly contacts the intermediate transfer belt 22 to supply the solid lubricant agent 26*a* to the intermediate transfer belt 22. The solid lubricant agent 26*a* is supplied to the intermediate transfer belt 22 to improve cleaning performance of the intermediate transfer belt 22 and to prevent filming on the intermediate transfer belt 22, thereby enhancing durability of the intermediate transfer belt 22.

Before images are written on the surfaces of the photoconductors 21, the surfaces of the photoconductors 21 are charged to about −700 V by the respective chargers 16 provided on an upstream side from the portions where the light beams 11 are directed relative to a direction of rotation of the photoconductors 21. Each of the chargers 16 according to illustrative embodiments includes a conductive rubber roller. The conductive rubber roller included in each of the chargers 16 is positioned about 50 μm from each of the photoconductors 21 to charge the surface of each of the photoconductors 21 in a contactless manner. An alternating electric current of about 1 kHz with a peak voltage of 2 kV is applied to each of the conductive rubber rollers such that the voltage at the center of each of the conductive rubber rollers is set to be about −800 V. Accordingly, the surfaces of the photoconductors 21 are evenly charged to about −700 V.

Alternatively, instead of charging the surfaces of the photoconductors 21 in a contactless manner as described above, for example, conductive rubber rollers may be provided to contact the surfaces of the photoconductors 21 to charge the surfaces of the photoconductors 21, respectively. Further alternatively, AC/DC charging, DC bias roller charging in which a DC bias of about −1,400 V is applied to charge the surfaces of the photoconductors 21 without applying an AC bias, widely-used corona charging using a corotron or scorotron, brush charging, or the like may be used as charging means according to illustrative embodiments.

After the surfaces of the photoconductors 21 are evenly charged by the chargers 16, the light beams 11 are emitted from the image writing part 12 onto the surfaces of the photoconductors 21 to write images on the surfaces of the photoconductors 21, respectively. Accordingly, electrostatic latent images corresponding to an image of each color of yellow, cyan, magenta, or black is formed on the surfaces of the photoconductors 21, respectively. The electrostatic latent images thus formed are developed by the developing devices 20 for each color of yellow, cyan, magenta, or black.

Figure 3:
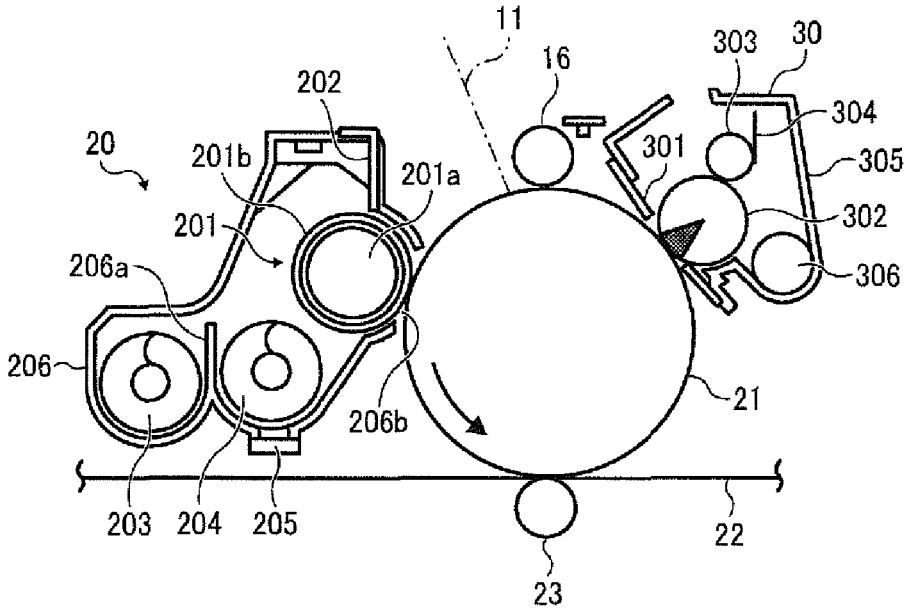
FIG. 3 is a cross-sectional view illustrating a configuration of an image forming unit of the image forming apparatus.

FIG. 3 is a cross-sectional view illustrating a configuration of the image forming unit of the image forming apparatus 10. Referring to FIG. 3, each of the developing devices 20 includes a developing roller 201, a doctor blade 202, two screws 203 and 204, a toner density sensor 205, a casing 206, and so forth. The two screws 203 and 204 are arranged below and to one side of the developing roller 201 and parallel to each other in a horizontal direction. The casing 206 includes a partial partition plate 206*a* provided between the two screws 203 and 204 that partially separates the interior of the casing 206 into two continuous chambers. A cutout is provided in the partial partition plate 206*a* so that developer inside the casing 206 can be circulated between the two chambers by the two screws 203 and 204.

An opening 206*b* is provided in the casing 206 at a portion where the developing devices 20 face the photoconductors 21, respectively, so that a part of the developing roller 201 is exposed from the opening 206*b*. The developing roller 201, the two screws 203 and 204, and the doctor blade 202 are arranged such that a larger space can be provided above the screw 204 in the casing 206 as illustrated in FIG. 3. The casing 206 of each of the developing devices 20 stores developer for each color of yellow, magenta, cyan, or black to develop the electrostatic latent images corresponding to each color formed on the surfaces of the photoconductors 21. Here, two-component developer including non-magnetic toner and magnetic carriers is used as the developer.

The developer stored in the developing devices 20 is agitated and constantly circulated between the two chambers in the casing 206 through the cutout provided in the partial partition plate 206*a* by the two screws 203 and 204 and rotating in opposite directions. The developer is supplied to the developing roller 201 by the screw 204 while being agitated and circulated as described above. The developing roller 201 includes an inner magnet roller 201*a* serving as a magnetic field generator and an outer non-magnetic developing sleeve 201*b* rotatably provided around an outer circumferential surface of the inner magnet roller 201*a*.

The developer thus supplied to the developing roller 201 is attracted to a surface of the developing sleeve 201*b* by a magnetic force generated by the inner magnet roller 201*a* and rotation of the developing sleeve 201*b* and held in the form of a magnetic brush on the surface of the developing sleeve 201*b*. The developer thus held on the surface of the developing sleeve 201*b* in the form of a magnetic brush is then conveyed to the opening 206*b* of the casing 206 as the developing sleeve 201*b* rotates. An amount of the developer on the developing sleeve 201*b* is appropriately adjusted by the doctor blade 202 before reaching the opening 206*b*. Thereafter, an appropriate amount of the developer is further conveyed to a developing range formed between a portion on the surface of the developing roller 201 exposed from the opening 206*b* and the surface of the photoconductor 21.

The developer prevented from being conveyed to the developing range by the doctor blade 202 falls onto the screw 204 by its own weight along an outer circumference of the developer held on the surface of the developing sleeve 201*b* in the form of a magnetic brush, and is returned to a circulation conveyance path within the casing 206. The developer thus returned to the circulation conveyance path is again agitated and conveyed by the two screws 203 and 204, and then is supplied to the developing roller 201 from the screw 204 again.

Meanwhile, toner of the developer conveyed to the developing range moves to the electrostatic latent image formed on the surface of the photoconductor 21 to develop the electrostatic latent image into a visible toner image. Accordingly, a toner image is formed on the surface of the photoconductor 21.

Specifically, a developing bias comprised of an alternating electric current of 2.25 kHz with a peak voltage of about 1 kV is applied to the developing sleeve 201*b*, such that the voltage at the center of the developing sleeve 201*b* is set to be −500 V. The toner included in the developer held on the surface of the developing sleeve 201*b* moves to the electrostatic latent image formed on the surface of the photoconductor 21 by a difference in electric potential between the developing sleeve 201*b* and a portion of the surface of the photoconductor 21 having a charging electric potential of about −150 V to where the light beam 11 has been directed.

Extra developer including toner and carrier not consumed for developing the electrostatic latent image remains held by the developing sleeve 201*b* and then is returned to the casing 206. Thereafter, the extra developer is removed from the developing sleeve 201*b* at a portion on the surface of the developing sleeve 201*b* where a magnetic force generated by the inner magnet roller 201*a* does not act, and falls onto the screw 204 by its own weight. Accordingly, the extra developer is collected to the circulation conveyance path in the casing 206 and is again agitated and conveyed by the two screws 203 and 204 to be supplied to the developing roller 201 by the screw 204 again.

As described above, the developer is repeatedly supplied to the developing sleeve 201*b* and collected to the casing 206 while being agitated and conveyed by the two screws 203 and 204 and circulated within the casing 206. When the above-described developing processes for developing the electrostatic latent images formed on the surfaces of the photoconductors 21 are repeatedly performed and toner included in the developer is consumed, a toner density of the developer stored in the casing 206 is gradually decreased. In each of the developing devices 20, the toner density of the developer stored in the casing 206 is monitored by the toner density sensor 205. Replenishing toner is supplied to the casing 206 from a toner supply device, not shown, as appropriate based on readings obtained by the toner density sensor 205 to keep the toner density of the developer stored in the casing 206 constant.

The toner images of each color thus formed on the surfaces of the photoconductors 21 are sequentially transferred onto the intermediate transfer belt 22 in a superimposed manner by the primary transfer bias rollers 23 provided opposite each of the photoconductors 21. The intermediate transfer belt 22 is rotated while contacting the surface of each of the photoconductors 21. Specifically, the toner images formed on the photoconductors 21 are electrostatically transferred onto the intermediate transfer belt 22 by the primary transfer bias rollers 23 provided opposite the photoconductors 21 with the intermediate transfer belt 22 therebetween using a transfer electric field generated at each of primary transfer ranges formed between the photoconductors 21 and the intermediate transfer belt 22, respectively.

A conductive sponge roller is generally used as the primary transfer bias rollers 23. An ionic conductive agent or an electron conductive agent such as carbon is mixed with a rubber material in order to provide conductivity to the sponge roller. However, a roller including the electron conductive agent generally has a large uneven resistivity and is not appropriate for performing transfer.

Therefore, according to illustrative embodiments, each of the primary transfer bias rollers 23 includes an ionic conductive NBR rubber foam having a hardness of 40 degrees on the ASKA-C hardness scale and a resistivity of $10^7\Omega$. A transfer bias is applied to each of the primary transfer bias rollers 23 to generate a transfer electric field.

The intermediate transfer belt 22 may be made of a variety of materials. It is preferable that the intermediate transfer belt 22 be a polyimide belt having superior durability and a Young's modulus or a PVDF belt having superior surface smoothness. Alternatively, the intermediate transfer belt 22 may be a multi-layered belt, including, for example, a polyurethane resin layer, a polyurethane rubber layer formed on the polyurethane resin layer, a coating layer containing a fluorine component formed on the polyurethane rubber layer, and an elastic layer at the top thereof.

Although the method for manufacturing the intermediate transfer belt 22 and the materials included in the intermediate transfer belt 22 are not particularly limited as described above, the intermediate transfer belt 22 according to illustrative embodiments includes a polyimide resin having appropriate strength. A surface resistivity of the intermediate transfer belt 22 is $1\times10^{11}\Omega/\square$, and a volume resistivity thereof is $1\times10^9\ \Omega$cm.

The intermediate transfer belt 22 including a polyimide resin may be formed by a generally used method. Specifically, a polymer solution into which carbon black is dispersed is poured into a metal cylinder and is heated to a temperature range of between 100° C. and 200° C. while the metal cylinder is rotated. As a result, a seamless film is formed by centrifugal formation. The film thus formed in a partially hardening state is removed from the metal cylinder and then is placed on an iron core to promote the imide reaction at a temperature in a range between 300° C. and 450° C., so that the film is harden and the intermediate transfer belt 22 is obtained. At this time, characteristics of the intermediate transfer belt 22 can be adjusted by changing the conditions of production, such as the amount of carbon, the heating temperature, the hardening speed, and so forth. A volume resistivity and a surface resistivity of the intermediate transfer belt 22 can also be adjusted by the above-described methods.

It is to be noted that the volume resistivity and the surface resistivity of the intermediate transfer belt 22 described above were respectively measured by a high resistivity meter (Hiresta-Up MCP-HT450 manufactured by Mitsubishi Chemical Corporation) using an UTS probe (MCP-HTP14 manufactured by Mitsubishi Chemical Corporation).

The toner images of each color formed on the surfaces of the photoconductors 21 are primarily transferred onto a surface of the intermediate transfer belt 22 in a superimposed manner, so that a full-color toner image including four colors is formed on the intermediate transfer belt 22. The full-color toner image formed on the intermediate transfer belt 22 is secondarily transferred by the secondary transfer bias roller 60 onto the transfer paper fed by the pair of registration rollers 17 and borne by the transfer conveyance belt 50. The transfer paper having the full-color toner image thereon is conveyed to the fixing device 15 by the transfer conveyance belt 50. The full-color toner image is fixed to the transfer paper by the fixing device 15, and then the transfer paper having a fixed full-color image thereon is discharged from the image forming apparatus 10. The toner remaining on the surface of the intermediate transfer belt 22 after secondary transfer is removed from the intermediate transfer belt 22 by the belt cleaning device 25. Thereafter, the next sequence of image forming operations is performed by the image forming units of each color in the image forming part 13.

A description is now given of the cleaning devices 30 that remove toner remaining on the surfaces of the photoconductors 21 after primary transfer.

As illustrated in FIG. 3, each of the cleaning devices 30 according to illustrative embodiments includes a cleaning blade 301 including elastic polyurethane rubber and a conductive fur brush 302. A metal electric field roller 303 is provided to contact the fur brush 302. A scraper 304 is provided to contact the electric field roller 303.

First, the toner remaining on the surface of the photoconductor 21 after primary transfer is removed from the surface of the photoconductor 21 by the fur brush 302 rotated in a direction opposite a direction of rotation of the photoconductor 21 at a portion where the fur brush 302 contacts the photoconductor 21. The toner attached to the fur brush 302 at this time is attracted to the electric field roller 303 rotated in a direction opposite the direction of rotation of the fur brush 302 at a portion where the electric field roller 303 contacts the fur brush 302, so that the toner is removed from the fur brush 302 by the electric field roller 303. Thereafter, the toner attached to the electric field roller 303 is scraped off by the scraper 304 and collected within a cleaning casing 305. It is to be noted that a cleaning bias is applied to the electric field roller 303 so that the toner remaining on the surface of the photoconductor 21 is moved to the fur brush 302 and is further moved to the electric field roller 303 by an electrostatic force generated by the cleaning bias, after which the toner is scraped off of the electric field roller 303 by the scraper 304.

The toner thus collected within the cleaning casing 305 is conveyed to a waste toner bottle, not shown, or the respective developing devices 20 of the same color by a collection screw 306. In the image forming apparatus 10 described above, the toner collected within the cleaning casing 305 is returned to the respective developing devices 20 by the collection screw 306 for reuse.

The cleaning device 30 is positioned higher than the developing device 20 of the adjacent image forming unit provided on a downstream side from the image forming unit including the cleaning device 30 relative to the direction of rotation of the intermediate transfer belt 22. Specifically, the cleaning device 30 is provided such that the collection screw 306 is positioned on a portion of the casing 206 above the screw 203 of the developing device 20 provided in the adjacent image forming unit. Accordingly, the image forming units are arranged close to one another, minimizing a size of the image forming apparatus 10.

One possible problem with the image forming apparatus 10 having the image forming part 13 illustrated in FIG. 2 is that, for example, a yellow toner image and a cyan toner image transferred onto the intermediate transfer belt 22 at an earlier stage of primary transfer contact the surfaces of the photoconductors 21M and 21K in the image forming units of magenta and black provided on a downstream side from the image forming units of yellow and cyan relative to the direction of rotation of the intermediate transfer belt 22. At this time, the yellow and cyan toner images may be reversely transferred onto the surfaces of the photoconductors 21M and 21K, and consequently, image quality of the toner images primarily transferred onto the intermediate transfer belt 22 may be degraded. In order to maintain good image quality, the toner images of specific colors already transferred onto the intermediate transfer belt 22 must be prevented from being reversely transferred onto the surfaces of the photoconductors 21 for other colors when contacting the surfaces of those photoconductors 21.

Reverse transfer is caused by electric discharge between the non-image portions of the toner images formed on the surfaces of the photoconductors and the transferred member. Toner images of specific colors already transferred onto a transferred member tend to be reversely transferred onto non-image portions of toner images of other colors formed on surfaces of photoconductors during transfer when the toner images of other colors are transferred onto the transferred member from the surfaces of the photoconductors. Electric discharge tends to occur more often at the non-image portions of the toner images compared with image portions of the toner images because a difference in an electric potential between the transferred member and the photoconductors is larger at the non-image portions compared with the image portions.

Figure 4:
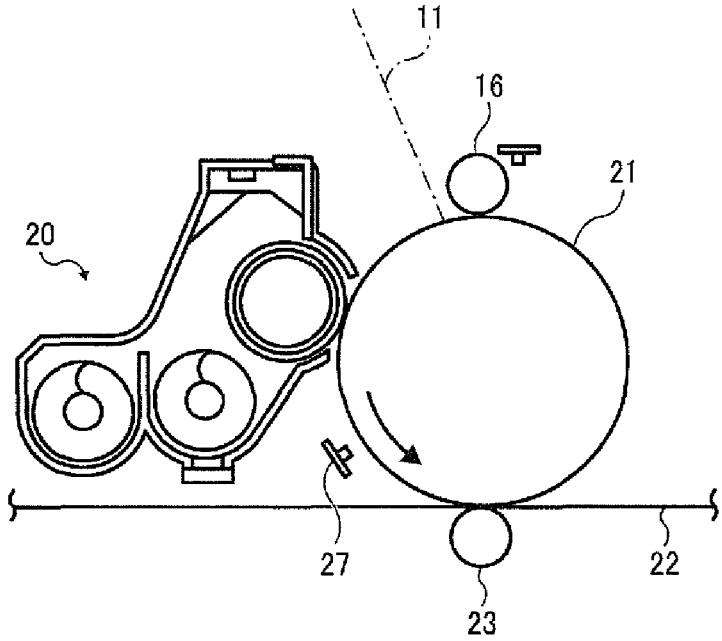
FIG. 4 is a cross-sectional view illustrating an image forming unit including a PTL.

One possible technique to prevent reverse transfer of the toner images is to provide a pre-transfer lamp (PTL). FIG. 4 is a cross-sectional view illustrating an image forming unit including the PTL. In the image forming unit illustrated in FIG. 4, light is directed onto the surface of the photoconductor 21 from a PTL 27, which may be an LED, an LD, a xenon lamp (a quenching lamp), or the like, so that an electric potential on the surface of the photoconductor 21 is reduced before the toner image formed on the surface of the photoconductor 21 is primarily transferred onto the intermediate transfer belt 22. The PTL 27 according to illustrative embodiments is an LED array. The electric potential on the surface of the photoconductor 21 is reduced by the PTL 27 as described above, so that a difference in the electric potentials between non-image portions of the toner image formed on the surface of the photoconductor 21 and the Intermediate transfer belt 22 is reduced, thereby considerably preventing reverse transfer of the toner image.

Since control of the electric potentials on the photoconductor 21 and the intermediate transfer belt 22 is one way to control imaging, at this point a description of pattern-based toner image density adjustment in general is in order.

A toner patch, for example, for detecting the density of the toner image (hereinafter simply "density detection") may be used as a pattern for image adjustment. Such a toner patch for toner image density detection and thus ultimately image adjustment is formed on an image bearing member such as the photoconductors 21, and then the toner patch thus formed is transferred onto a transferred member such as the intermediate transfer belt 22. Thereafter, a density of the toner patch is detected on the transferred member by a detector that may be an optical detector, and both a toner density and a developing potential are adjusted based on the readings, or detection results, obtained by the detector. It is to be noted that adjustment of the developing potential includes change of writing power, a charging bias, and a developing bias.

Figure 5:
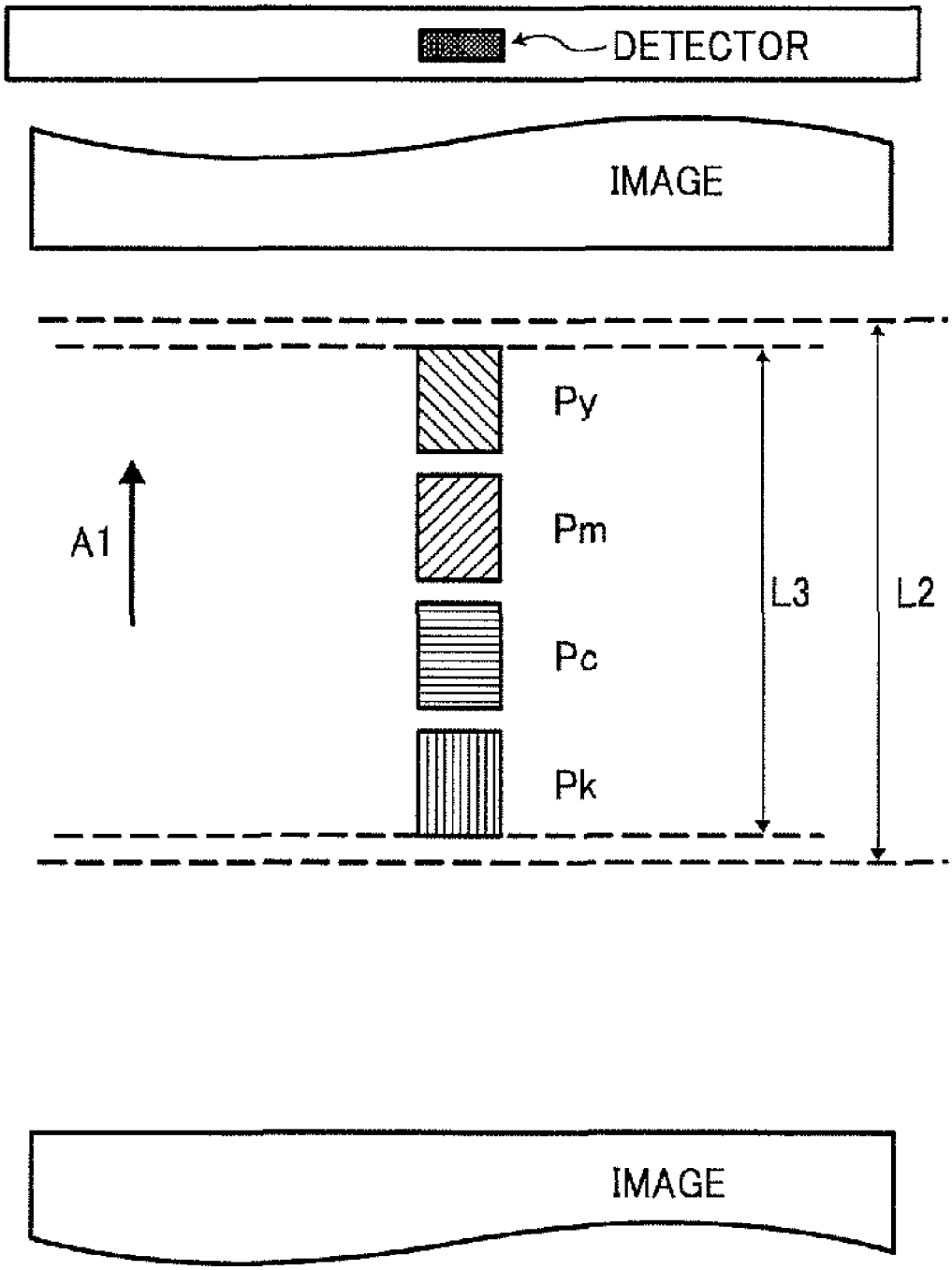
FIG. 5 is a view illustrating an example of a pattern for image adjustment.

FIG. 5 is a view illustrating an example of a pattern for image adjustment. In FIG. 5, reference symbols Py, Pm, Pc, and Pk denote toner patches for density detection for each colors of yellow, magenta, cyan, and black, respectively.

According to illustrative embodiments, the toner patches Py, Pm, Pc, and Pk have a size of 15 mm (vertical) X 15 mm (horizontal), respectively, and are formed with an interval of 5 mm between one another. Accordingly, a length of a portion on the surface of the intermediate transfer belt 22 having the toner patches Py, Pm, Pc, and Pk thereon (hereinafter referred to as L2) is 75 mm. Unlike the toner images of each color sequentially transferred onto the intermediate transfer belt 22 and superimposed on one another during image formation, the toner patches Py, Pm, Pc, and Pk are transferred onto the intermediate transfer belt 22 side by side, without being superimposed on one another. As a result, a single pattern block including the toner patches for density detection Py, Pm, Pc, and Pk for each color is formed on the intermediate transfer belt 22.

A widely-used reflection sensor, including a light emitting element such as an LED and a light receiving element such as a photodiode (PD) or a phototransistor (PTr), can be used as the detector for detecting the toner patches for density detection.

Figure 6:
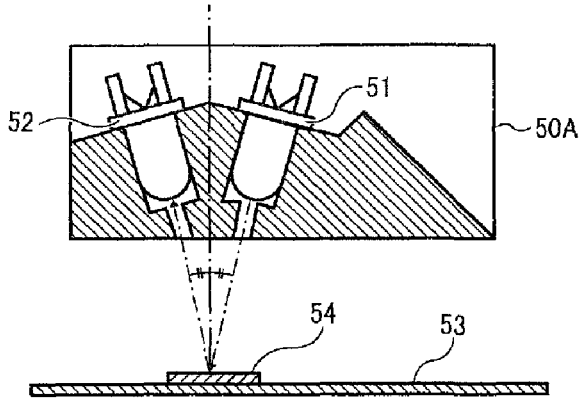
FIG. 6 RELATED ART
FIG. 6 is a cross-sectional view illustrating an example of a reflection sensor of the related art.
Figure 7:
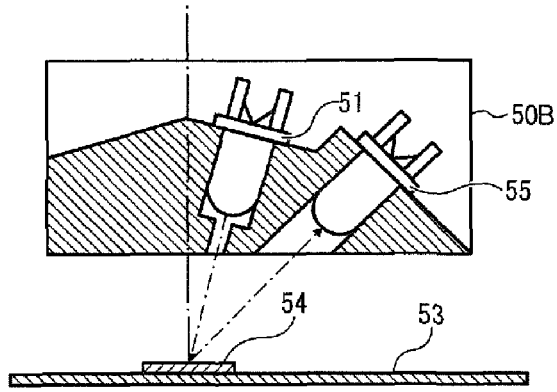
FIG. 7 RELATED ART
FIG. 7 is a cross-sectional view illustrating another example of a reflection sensor of the related art.
Figure 8:
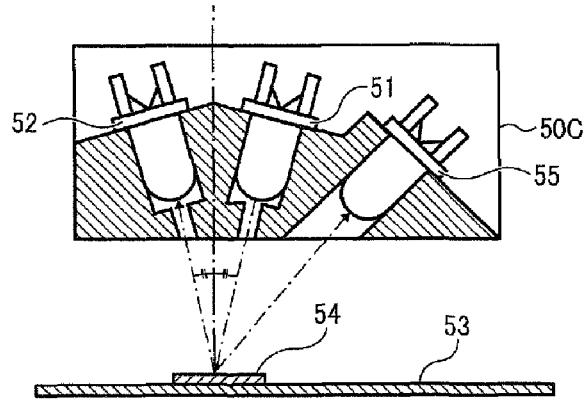
FIG. 8 RELATED ART
FIG. 8 is a cross-sectional view illustrating yet another example of a reflection sensor of the related art.

FIGS. 6, 7, and 8 are cross-sectional views respectively illustrating examples of related-art reflection sensors. Specifically, FIG. 6 is a cross-sectional view illustrating a reflection sensor for only detecting regular reflected light. FIG. 7 is a cross-sectional view illustrating a reflection sensor for only detecting diffuse reflected light. FIG. 8 is a cross-sectional view illustrating a reflection sensor for detecting both regular reflected light and diffuse reflected light. In FIGS. 6, 7, and 8, reference numerals 50A, 50B, and 50C denote an element holder, respectively. Reference numerals 51, 52, 53, 54, and 55 denote an LED, a regular reflected light receiving element, a surface to be detected, a toner patch formed on the surface to be detected, and a diffuse reflected light receiving element, respectively.

In addition to the toner patch for density detection described above, a pattern for positioning can also be used as the pattern for image adjustment. For example, Japanese Patent No. 3558620 discloses a pattern for positioning. It is to be noted that, according to illustrative embodiments of this patent specification, the pattern for image adjustment is formed every 100 sheets, that is, each time images are formed on 100 sheets of transfer paper.

A description is now given of a detector for detecting an amount of charge of the toner. It is important to detect the toner charge amount correctly in order to adjust the electric potentials correctly and thus ultimately obtain good quality images.

As a preliminary matter, it is to be noted that it is possible to estimate the amount of charge of the toner without a detector. Thus, a predictive formula suggested in the experiments of Schein et al. and widely used to calculate a developed toner mass per unit area (m/A) is expressed as follows:

$$\frac{m}{A} = \frac{\pi\varepsilon o}{2T} \cdot \frac{vr}{vp} \cdot \frac{RVo}{L(l + r/\varepsilon t)} \quad (1)$$

where T represents an amount of charge of toner (q/m), r represents a radius of a toner particle, $v_r$ represents a linear velocity of a developing roller, $V_P$ represent a linear velocity of a photoconductor, $\in_t$ represents a relative permittivity of toner, L represents a gap between a developing roller and a photoconductor, l represents a dielectric thickness of a coat layer of a carrier, R represents a radius of a carrier, and $V_0$ represents an electric potential of a photoconductor or a difference between an electric potential at an image portion of a toner image formed on a photoconductor (determined by a charging bias and a writing power) and an electric potential of a developing bias.

Here, it is assumed that, in high-resistance developer, an electric charge having a polarity opposite a polarity of the toner remains on a surface of a carrier from which the toner is removed for development. Further, it is also assumed that development is completed when an electric field generated by a latent image formed on the photoconductor and an electric field generated by the electric charge having the polarity opposite the polarity of the toner generated on the carrier become zero at a developing air gap. The formula (1) is provided on the above-described assumptions.

It has been found that, in a case in which m/A on the photoconductor is adjusted to be a predetermined value using the pattern for image adjustment as described above under a predetermined set of conditions pertaining to toner type, carrier type, and ratio of the linear velocities, the amount of charge of toner T and the electric potential Vo of the photoconductor are proportionate and can be approximated using the formula (1).

As a result, the amount of charge of toner T can be calculated at the same time m/A is adjusted, or more specifically, when a writing power, a charging bias, and a developing bias are changed, using the pattern for image adjustment described above.

Figure 9:
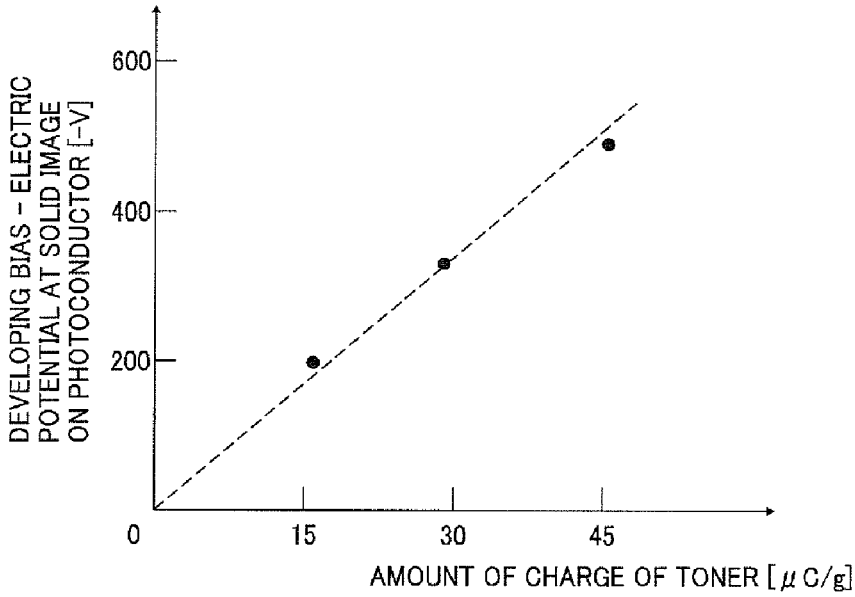
FIG. 9 is a graph illustrating a relation between an amount of charge of toner and an electric potential on a photoconductor.

A graph illustrating the relation between the amount of charge of toner T and the electric potential of the photoconductor Vo when m/A at a solid image portion of the toner image is 0.45 [mg/cm$^2$] obtained by experiment is shown in FIG. 9. It is clear from FIG. 9 that data obtained by the experiment produced the result described above.

A description is now given of writing control means. First, as a basis for comparison, an arrangement without a measuring device that measures an electric potential on a surface of a photoconductor is described in detail below.

Figure 10:
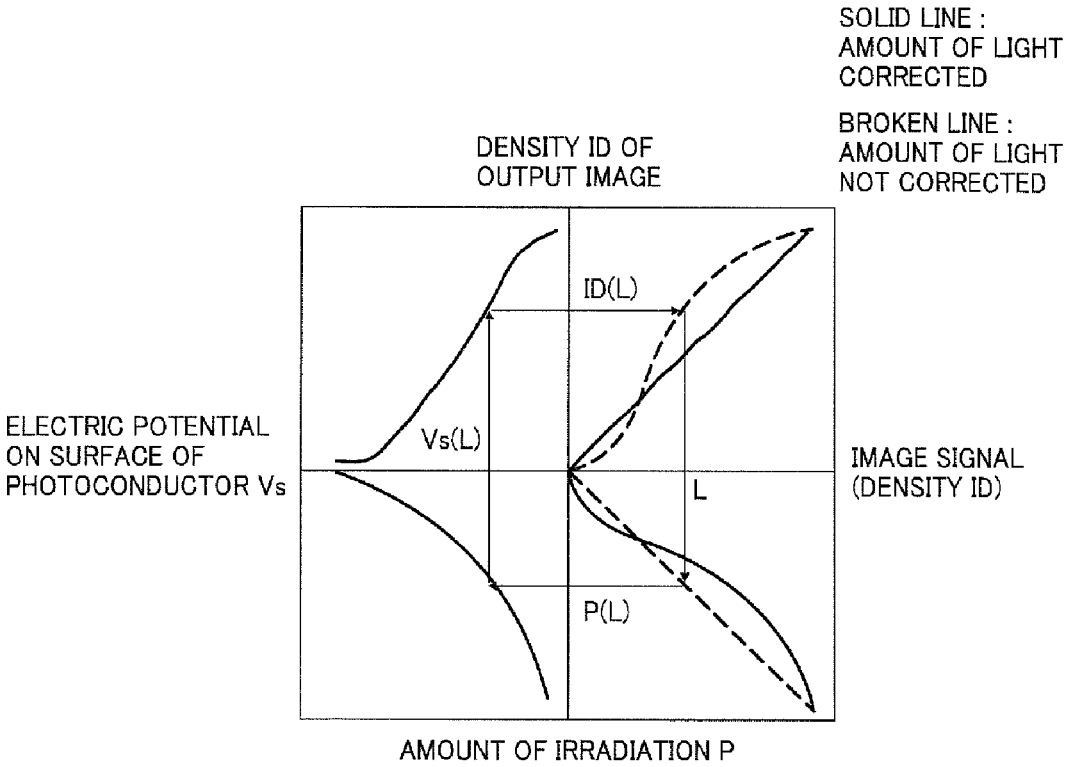
FIG. 10 is a graph illustrating a relation between an amount of irradiation and an electric potential on a photoconductor.

An amount of light emitted from the image writing part 12 (hereinafter referred to as an amount of irradiation) based on the image signal can be estimated from a solid line in a fourth quadrant in FIG. 10. In general, an amount of irradiation is determined only by an image signal for an image to be formed currently. However, according to illustrative embodiments of this patent specification, an amount of irradiation is determined by a previous image signal for an image formed on the photoconductor 21 during a previous sequence of image forming operations (hereinafter referred to as an image signal B) as well as an image signal for an image to be formed currently (hereinafter referred to as an image signal A).

First, a proportional coefficient k necessary for control during image density adjustment is obtained by using the following formula:

$k = a \times$(developing bias ($V$)−electric potential at solid image portion of toner image formed on photoconductor ($V$)).

As described above in FIG. 9, a difference between the developing bias (V) and the potential at the solid image portion of the toner image formed on the photoconductor (V) can be used as a guide to obtain the amount of charge of toner T. An appropriate value of a constant a varies depending on a configuration of a charger, a transfer device, or a photoconductor, or a toner type. Therefore, it is necessary to obtain experimentally and in advance an appropriate constant a that prevents memory effects for a given configuration. In the image forming apparatus 10 according to illustrative embodiments of this patent specification, the constant a was obtained experimentally and set to 0.00033.

When electric potentials during image adjustment were measured during operation of the image forming apparatus 10 under laboratory conditions, a developing bias was −500 V and an electric potential at a solid image of a toner image formed on the photoconductor 21 was −200 V. Accordingly, the proportional coefficient k was set to 0.1. When an amount of irradiation α determined by the image signal A and an amount of irradiation β determined by the image signal B are estimated from the graph illustrated in FIG. 10, an amount of irradiation performed by the image writing part 12 was controlled to be α+0.1×β. Accordingly, no memory effects could be visually confirmed.

As a check, the image forming apparatus 10 was then operated under conditions of reduced temperature and humidity, as a result of which process control to change an electric potential at a solid image portion of a toner image formed on the photoconductor 21 to −150 V and a developing bias to −600 V was performed during image adjustment. Therefore, the proportional coefficient k was changed to 0.15 in accordance with process control.

When image writing was controlled in accordance with the above-described equation of α+0.1×β under conditions of reduced temperature and lower humidity, the memory effects did not appear on resultant images. The proportional coefficient k was then set to 0.07 under higher temperature and higher humidity. When image writing was controlled in accordance with the above-described equation of α+0.1×β under higher temperature and higher humidity with the proportional coefficient k of 0.07, the memory effects did not appear on resultant images. Accordingly, it was confirmed that the memory effects are reliably removed even when environmental conditions are varied.

A description is now given of a case in which a measuring device that detects an electric potential on the surface of the photoconductor 21 is provided.

Figure 11:
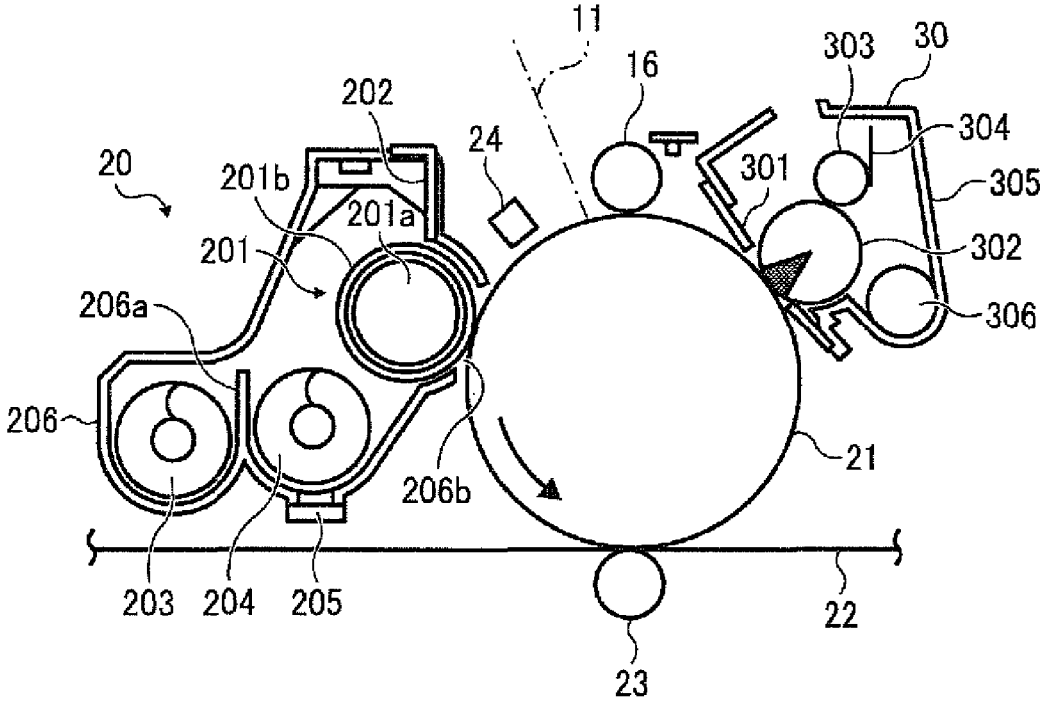
FIG. 11 is a cross-sectional view illustrating a configuration of an image forming unit including a surface potential sensor according to illustrative embodiments.

Image forming apparatuses for providing higher image quality and higher productivity generally include a sensor to detect an electric potential on a surface of a photoconductor. As illustrated in FIG. 11, the image forming apparatus 10 according to illustrative embodiments includes surface potential sensors 24 to detect an electric potential on the surfaces of the photoconductors 21 after the surfaces of the photoconductors 21 are evenly charged by the chargers 16, respectively. In a case in which the surface potential sensors 24 are not provided, a degree of the memory effects needs to be predicted and accounted for from the amount of charge of the toner as described above. However, the degree of the memory effects can be directly detected by provision of the surface potential sensors 24.

Figure 12A:
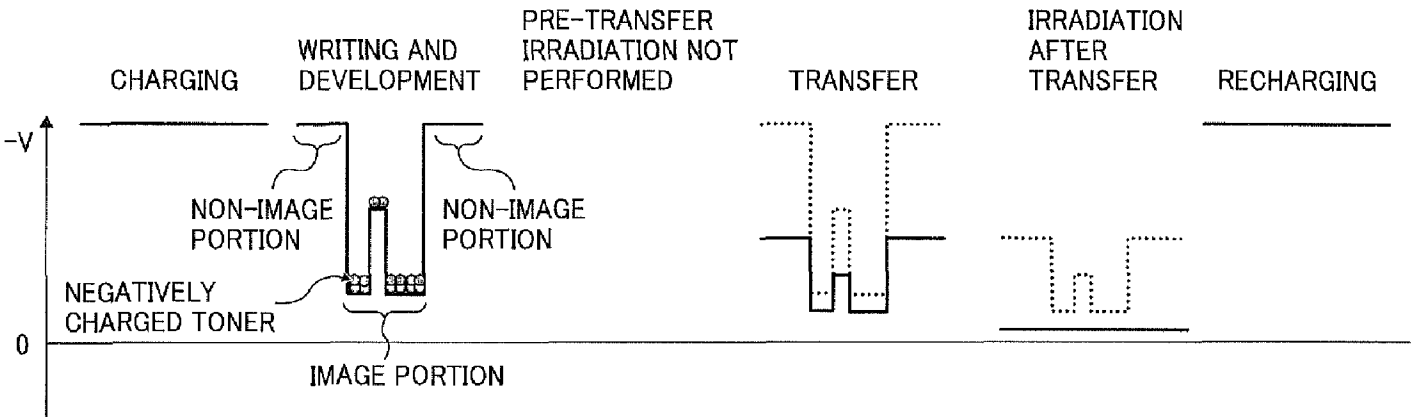
FIGS. 12A and 12B are graphs respectively illustrating an example of a result of measurement of memory effects.
Figure 12B:
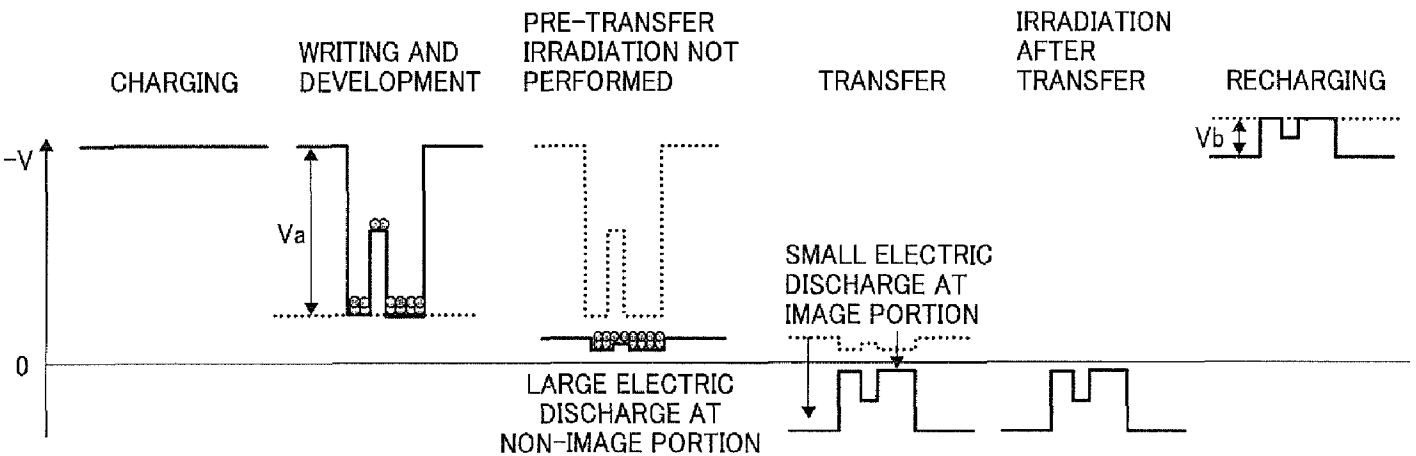
Figure 13A:
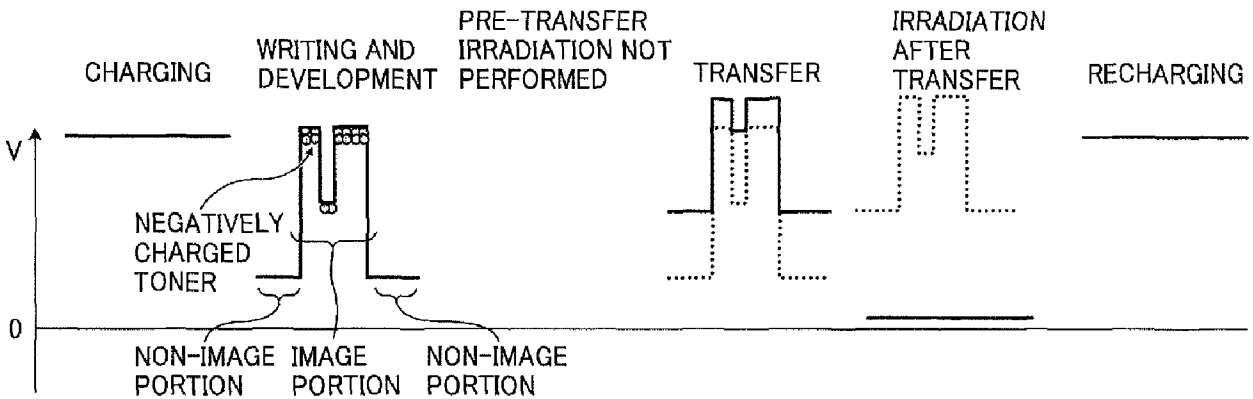
FIGS. 13A, 13B, and 13C are graphs respectively illustrating another example of a result of measurement of memory effect.
Figure 13B:
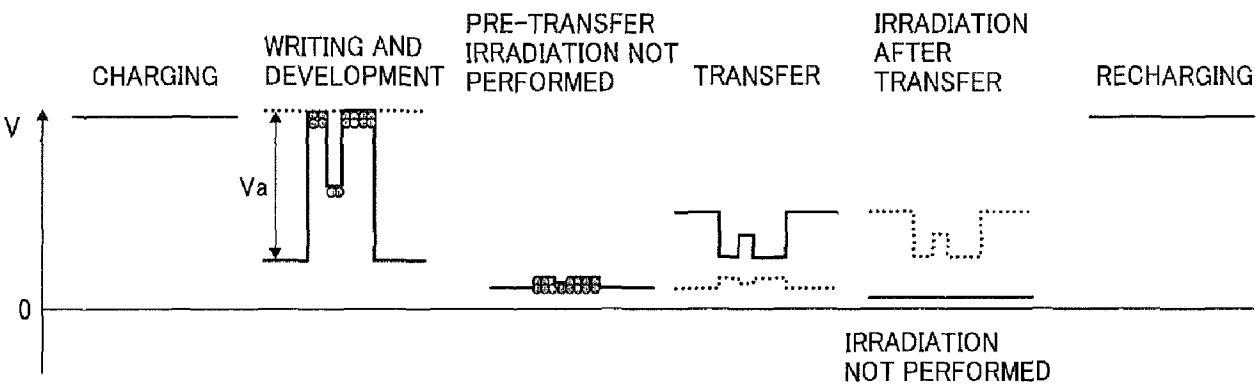
Figure 13C:
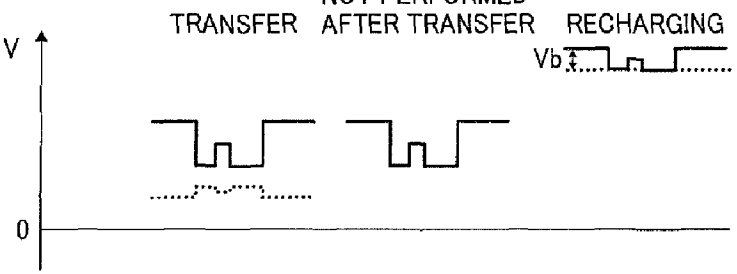

A description is now given of how to measure the memory effects. FIGS. 12A, 12B, 13A, 13B, and 13C are graphs respectively illustrating a result of measurement of the memory effects. To measure the degree of the memory effects, first, a pattern of a solid image, a length of which in a sub-scanning direction is shorter than a circumference of the photoconductor 21, is written on the surface of the photoconductor 21. Immediately after the pattern is written, a difference in an electric potential between an image portion of the pattern and a non-image portion of the pattern on the surface of the photoconductor 21 is measured. The difference in the electric potential measured at this time corresponds to Va shown in FIGS. 12B and 13B. Subsequently, processes of development, transfer, and recharging are performed. At this time, irradiation after transfer is not performed. Thereafter, a difference in an electric potential between the image portion of the pattern and the non-image portion of the pattern on the surface of the photoconductor 21 immediately after recharging, that is, an electric potential difference Vb in FIGS. 12B and 13C, is measured.

Then, the proportional coefficient k is set as k=Vb/Va. Accordingly, the memory effect can be reliably reduced regardless of changes over time. The above-described control is more desirably performed in more advanced image forming apparatuses equipped with the surface potential sensor. In illustrative embodiments, in a manner similar to that of the pattern for image adjustment, the electric potential difference Va, the electric potential difference Vb, and the proportional coefficient k are set each time images are output on 100 sheets of the transfer paper.

It was confirmed experimentally that after images were output on 3,000 sheets of the transfer paper under a variety of different conditions, no memory effects could be visually confirmed. It is to be noted that the above-described method for reducing the memory effects using writing can be used in a case in which the PTL 27 is not provided in the image forming apparatus 10.

According to illustrative embodiments, the use of the PTL 27 can improve transfer efficiency and considerably reduce the amount of toner reversely transferred from the intermediate transfer belt 22 to the surfaces of the photoconductors 21. However, pre-transfer irradiation causes the electric potential on the surfaces of the photoconductors 21 after transfer to be positive as illustrated in FIG. 12B. A positive electric polarity on the surfaces of the photoconductors 21 cannot be eliminated even if irradiation after transfer is performed because speed of movement of electrons generally used on the photoconductors 21 is too slow. Consequently, the image signal B for a previous sequence of image forming operations remains on the surfaces of the photoconductors 21 performing the next sequence of image forming operations as an uneven electric potential after transfer, that is, the memory effect.

When the image signal A for the next sequence of image forming operations is written on the photoconductors 21, an amount of writing light is adjusted based on the uneven electric potential caused by the image signal B for the previous sequence of image forming operations, thereby reducing uneven images caused by the memory effects.

According to illustrative embodiments, in a case of a reversal development system in which the charging polarity of the toner is the same as the charging polarity of the surface of the photoconductor 21, an electric potential at the non-image portion on the surface of the photoconductor 21 varies more greatly before and after transfer compared with an electric potential at the image portion on the surface of the photoconductor 21 as illustrated in FIG. 12B. In order to perform deletion of the memory of the image signal B for the previous sequence of image forming operations remaining on the surface of the photoconductor 21 and writing of the image signal A for the next sequence of image forming operations at the same time, a larger amount of light needs to be added to an amount of writing light for the image signal A to raise the electric potential at the image portion for the image signal B. In a case of a normal development system in which the charging polarity of the toner is opposite to that of the photoconductor 21, the polarity of the charger 16 and that of the intermediate transfer belt 22 are the same. Accordingly, as illustrated in FIGS. 13A, 13B and 13C, the electric potential on the surface of the photoconductor 21 is increased after transfer compared with that before transfer. In other words, the memory effects can be eliminated by irradiation after transfer.

However, provision of both the PTL 27 and a part to perform irradiation after transfer may cause light-induced fatigue of the photoconductors 21 as well as a cost increase of the apparatus. Therefore, in the case of the normal development system it is desirable to reduce the memory effects using the image writing part 12. This can be done as follows.

It is to be noted that, after transfer in the normal developing system, an electric potential at the non-image portion on the surface of the photoconductor 21 after transfer exceeds that of the image portion on the surface of the photoconductor 21. In order to perform deletion of the memory of the image signal B for the previous sequence of image forming operations remaining on the surface of the photoconductor 21 and writing of the image signal A for the next sequence of image forming operations at the same time, a larger amount of light needs to be added to an amount of writing light for the image signal A to raise the electric potential at the non-image portion for the image signal B.

According to illustrative embodiments, the image writing part 12 is controlled based on a formula $\alpha+k\times\beta$, where k is a proportional coefficient greater than zero. As a result, the memory effects can be reduced in both the reversal development system and the normal development system at reduced cost.

The larger the amount of charge of the toner, the stronger the memory of the image signal B after transfer. As described above, the reason is that the strength of the memory effect is determined by the difference in the amount of electric discharge between the non-image portion and the image portion during transfer, and the larger the amount of charge of the toner, the smaller the amount of electric discharge at the image portion.

Accordingly, the degree of the memory effect and the amount of charge of the toner are substantially proportional. According to illustrative embodiments, the proportional coefficient of the amount of irradiation is determined based on the amount of charge of the toner, thereby reliably reducing the memory effects even when the degree of the memory effects varies due to environmental changes.

Further, the image forming apparatus 10 according to illustrative embodiments includes an optical sensor for detecting an amount of toner attached to the pattern for image adjustment on the intermediate transfer belt 22. Even when the amount of charge of the toner is increased and development performance is decreased under an environment of lower temperature and lower humidity, or when the amount of charge of the toner is decreased and development performance is increased under an environment of higher temperature and higher humidity, the charging bias, the developing bias, and the writing power such as the amount of irradiation and the electric potential after irradiation are adjusted to keep the amount of the toner attached to the solid image constant. In other words, the amount of the toner attached to the solid image can be estimated from the charging bias, the developing bias, and the writing power.

According to illustrative embodiments, the strength of the memory effect can be predicted using the surface potential sensors 24 that measure the electric potential on the surface of the photoconductors 21 as well as by using the amount of charge of the toner. Accordingly, the electric potential difference Vb shown in FIGS. 12B and 13C can be directly measured, thereby more appropriately setting the proportional coefficient k.

This patent specification is based on Japanese Patent Application No. 2008-271667, filed on Oct. 22, 2008 in the Japan Patent Office, which is hereby incorporated herein by reference in its entirety.

What is claimed is:

1. An image forming apparatus, comprising:

a latent image carrier, rotated to bear an electrostatic latent image on a surface thereof;

a charger to evenly charge the surface of the latent image carrier;

a writing device to irradiate a charged surface of the latent image carrier with a light beam according to image data to form an electrostatic latent image on the charged surface of the latent image carrier;

a writing device control unit to control the writing device;

a developing device to develop the electrostatic latent image with a developer to form a toner image on the charged surface of the latent image carrier;

a transfer device to transfer the toner image formed on the charged surface of the latent image carrier onto a transferred member; and a pre-transfer irradiating device to irradiate the charged surface of the latent image carrier during a period after development and before transfer, wherein the writing device control unit controls the writing device to irradiate the charged surface of the latent image carrier based on an image signal B, causing an uneven electric potential on the charged surface of the latent image carrier to remain after the toner image is transferred onto the transferred member, and wherein the writing device control unit, after irradiating the charged surface of the latent image carrier based on the image signal B, controls the writing device to irradiate the charged surface of the latent image carrier based on the uneven electric potential caused by the irradiation based on the image signal B and an image signal A which is output a single rotation of the latent image carrier after the image signal B in a sub-scanning direction.

2. The image forming apparatus according to claim 1, wherein the writing device control unit controls the writing device based on an amount of irradiation calculated by a formula $\alpha+k\times\beta$, wherein a is an amount of irradiation [J/cm$^2$] required for writing and estimated from the image signal A, $\beta$ is an amount of irradiation [J/cm$^2$] required for writing and estimated from the image signal B, and k is a proportional coefficient greater than zero.

3. The image forming apparatus according to claim 2, wherein the proportional coefficient k varies depending on an amount of charge of toner in the developer.

4. The image forming apparatus according to claim 3, wherein the amount of charge of the toner is estimated from a charging bias, a developing bias, and an amount of writing light.

5. The image forming apparatus according to claim 3, further comprising a surface potential sensor to measure an electric potential on the surface of the latent image carrier on an upstream side from the developing device relative to a direction of rotation of the latent image carrier.

6. The image forming apparatus according to claim 5, wherein:

the surface potential sensor measures an electric potential difference Va between an image portion and a non-image portion of an image pattern having a length in a sub-scanning direction that is shorter than a circumference of the latent image carrier and formed on the surface of the latent image carrier during a period immediately after writing and before development, and an electric potential difference Vb between the image portion and the non-image portion of the image pattern on the surface of the latent image carrier during a period after recharging and before rewriting; and the proportional coefficient k is adjusted based on a ratio between the electric potential difference Va and the electric potential difference Vb.

7. The image forming apparatus according to claim 1, wherein in a case that (i) the toner image formed on the latent image carrier based on the image signal B has an image portion having toner thereon and a non-image portion not having toner thereon, and (ii) a charging polarity of the toner of the toner image formed on the latent image carrier based on the image signal B is same as a charging polarity of the surface of the latent image carrier, a larger amount of irradiation is applied to the charged surface of the latent image carrier based on the image signal A to raise an electric potential at a portion on the surface of the latent image carrier corresponding to the image portion of the toner image than another portion on the surface of the latent image carrier corresponding to the non-image portion.

8. The image forming apparatus according to claim 1, wherein in a case that (i) the toner image formed on the latent image carrier based on the image signal B has an image portion having toner thereon and a non-image portion not having toner thereon, and (ii) a charging polarity of the toner of the toner image formed on the latent image carrier based on the image signal B is opposite to a charging polarity of the surface of the latent image carrier, a larger amount of irradiation is applied to the charged surface of the latent image carrier based on the image signal A to raise an electric potential at a portion on the surface of the latent image carrier corresponding to the non-image portion of the toner image than another portion on the surface of the latent image carrier corresponding to the image portion.

* * * * *